US005520083A

United States Patent [19]

Falkner, Jr.

[11] Patent Number: 5,520,083

[45] Date of Patent: May 28, 1996

[54] CUSHIONED SUPPORT FOR DRUM

[75] Inventor: Jeff R. Falkner, Jr., Thousand Oaks, Calif.

[73] Assignee: Drum Workshop, Inc., Oxnard, Calif.

[21] Appl. No.: 377,218

[22] Filed: Jan. 24, 1995

[51] Int. Cl.[6] ..... G10G 5/00; G10D 13/02

[52] U.S. Cl. ..... 84/421

[58] Field of Search ..... 84/421, 453

[56] References Cited

U.S. PATENT DOCUMENTS

| | | | |
|---|---|---|---|
| 2,990,745 | 7/1961 | Casavant | 84/421 |
| 3,106,123 | 10/1963 | Johannsen | 84/421 |
| 3,191,484 | 6/1965 | Walling | 84/421 |
| 3,608,418 | 9/1971 | Chaffee et al. | 84/419 |
| 4,158,980 | 6/1979 | Gauger | 84/421 |

*Primary Examiner*—Cassandra Spyrou
*Attorney, Agent, or Firm*—William W. Haefliger

[57] ABSTRACT

A drum assembly comprises a cylindrical shell and a head on the shell; annular retainer structure on the shell and retaining the head to the shell; multiple studs rigidly attached to the shell at the outer side thereof; multiple threaded rods extending between the studs and the retainer structure; a support band extending about the shell, and at least part way about the studs; and elastomer cushions carried by the support band and extending at least part way about the studs and adjacently facing the shell to cushion loading transferred between the studs and the support band, and to acoustically isolate the shell and support band; and drum support structure on the support band. The cushions typically extend in planes parallel to the drum central main axis.

13 Claims, 3 Drawing Sheets

CUSHIONED SUPPORT FOR DRUM

BACKGROUND OF THE INVENTION

This application relates generally to drum structure, and more particularly, to the support of a drum in such a way as not to impair the audible sound when the drum is struck by a beater, such as a stick.

In the past, drum walls or shells were supported as by mounting means contacting the drum shells, or associated structure, in such manner that the beater-produced sound was somewhat impaired. For example, there was attenuation of certain acoustic frequencies that resulted in changed drum sound.

Attempts have been made to support drums via tension rods on the drums; however, such support imposed drum weight on one side of the top flange of the drum, which could impair or alter tuning of the drum sought by tension rod adjustment. No way was known, to my knowledge, to provide for drum support to achieve the unusual advantages in construction, operation and results, as now enabled by the present invention.

SUMMARY OF THE INVENTION

It is a major object of the invention to provide for improved drum support meeting the above needs and providing advantages, as referred to, as well as additional advantages in construction and use, as will be seen.

Basically, the invention is embodied in a combination comprising:

a) a cylindrical shell and a head on the shell, b) retainer structure on the shell and retaining the head to the shell, c) multiple studs rigidly attached to the shell at the outer side thereof, d) multiple threaded rods extending between the studs and the retainer, e) a support band extending about the shell, and at least part way about the studs, f) elastomer cushions carried by the support band and extending at least part way about the studs and adjacently facing the shell to cushion loading transferred between the studs and the support band, and to acoustically isolate the shell and support band, g) and drum support structure on the support band.

It will be noted that drum loading is taken through the studs attached to the side of the shell, rather than through the retention structure that retains the drum head to the drum shell.

It is another object to provide improved cushions or grommets that extend generally annularly about the studs and in planes generally parallel to a central axis defined by the shell. As will appear, the cushions typically extend closer to the shell than band extent adjacent the cushions.

Yet another object is the provision of cushions that are spaced apart and about the axis, at least one of the cushions engaging the shell. Four of such cushions are typically provided, spaced apart through an arc defined by the band, the arc extending between 170° and 190° about the axis.

A further object is to provide relatively large cushions having relatively large annular surfaces directly forcing the side wall of the drum to engage that wall and prevent de-tuning or altered tuning of the shell, acoustically. The cushions typically comprise elastomeric grommets defining annular grooves receiving edge extents of the band.

Yet another object is to so support the drum that the tension rods are isolated from the elastomeric cushions and C-shaped metal band, whereby such rods need not be adjusted to compensate for drum loading imposed on the drum head retention flange.

These and other objects and advantages of the invention, as well as the details of an illustrative embodiment, will be more fully understood from the following specification and drawings, in which:

DRAWING DESCRIPTION

DETAILED DESCRIPTION

Figure 1:
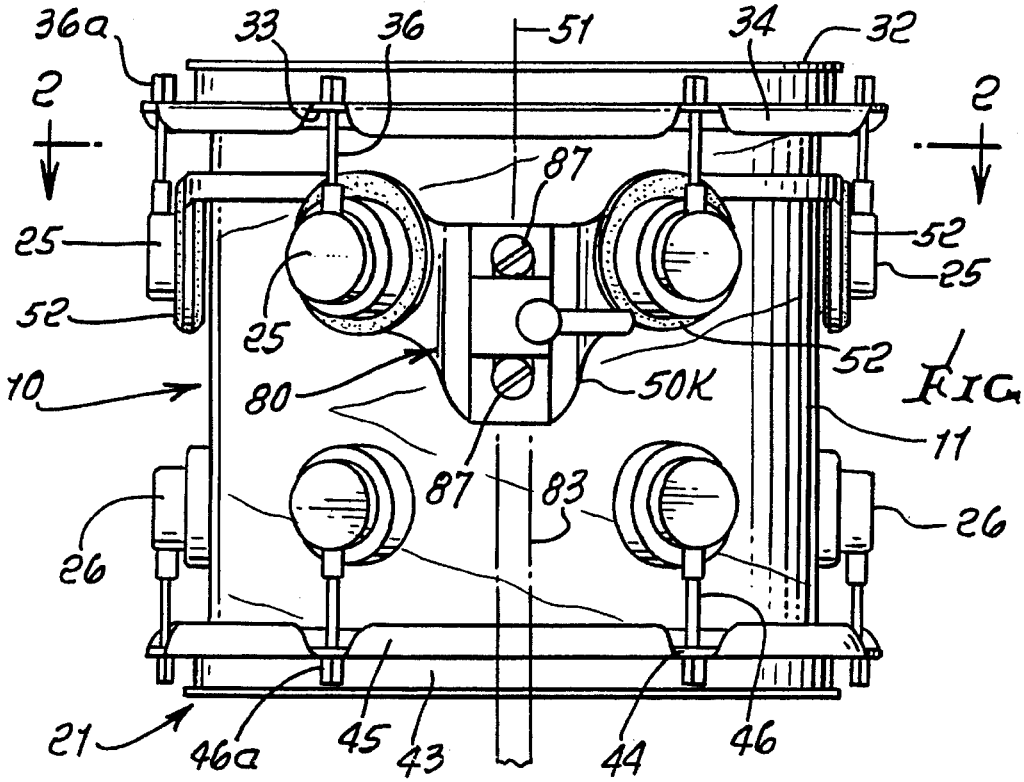
FIG. 1 is a side elevation of a drum incorporating the invention.

In the drawings, a drum 10 has a shell comprising a cylindrical section or sections located in axially extending position. Drum 10 may be a tom-tom.

Figure 3:
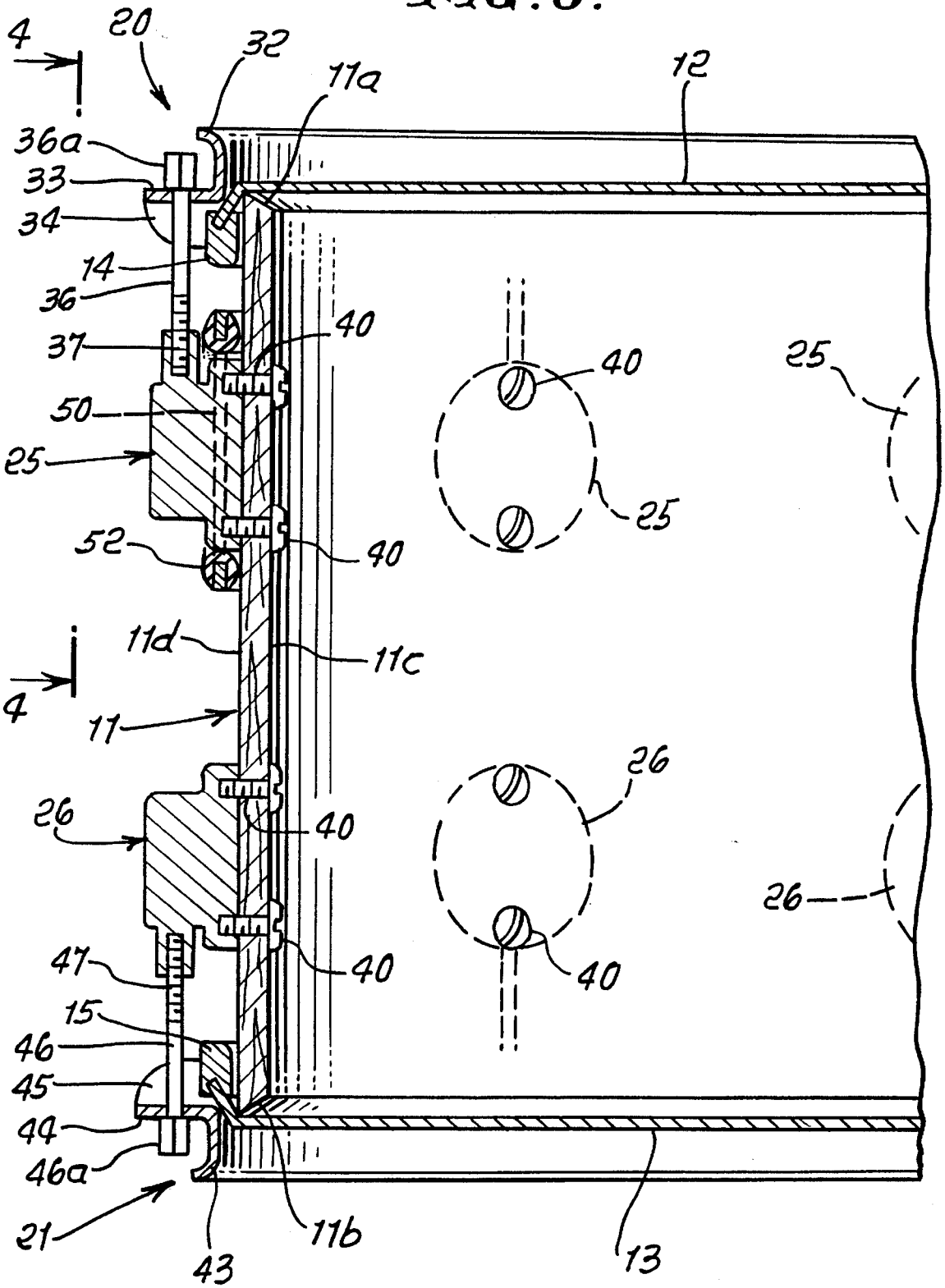
FIG. 3 is an enlarged section taken on lines 3—3 of FIG. 2.

Opposite annular and inwardly angled ends of the shell appear at 11*a* and 11*b* in FIG. 3. The shell typically consists of wood and has inner and outer cylindrical walls 11*c* and 11*d*.

Drum heads 12 and 13 extend over the shell ends 11*a* and 11*b* and are retained in taut condition. They may consist of thin sheets of plastic or other material. Annular metallic flanges 14 and 15 are typically attached to the respective heads 12 and 13 for retaining them in taut condition. Flanges 14 and 15 extend about opposite end extents of the shell.

The retainer structure shown includes flange structure 20 provided in association with one end 11*a* of the shell, and flange structure 21 in association with the other end 11*b* of the shell.

The upper flange structure 20 has an upwardly extending annular rim portion 32 extending above the level of drumhead 12, a medial annular portion 33 extending radially outwardly below the level of 32, for transmitting head tightening loading to flange 14, and a lower annular extending portion 34 extending downwardly from the outer extent of 33. A tightening adjustment fastener rod 36 extends downwardly through 33 and has external threads 37 that interfit internal threads in upper holder or stud 25. Note fastener head 36*a* bearing on the upper surface of 33. The lower surface of 33 exerts downward loading onto retention ring or flange to which drumhead 12 is attached, for adjusting its tautness, by drawing the head over 11*a*.

Likewise, lower flange structure 21 has a downwardly extending annular rim portion 43 extending below the level of drumhead 13, a medial annular portion 44 extending radially outwardly above the level of 43 for transmitting head tightening loading, and an upper annularly extending portion 45 extending upwardly from outer extent of 44. A tightening adjusting fastener rod 46 extends upwardly through 44 and has external threads 47 that interfit rotatably the internal threads in lower holder or stud 26. Note fastener head 46*a* bearing on the lower surface of 44. The upper surface of 44 exerts upward loading onto lower retention ring or flange 15 to which drumhead 13 is attached, for adjusting its tautness, i.e., over bevel 11*b*. Fasteners 40 connect 25 and 26 to 11. Accordingly, the drumheads are individually adjustable, and acoustic benefits are enabled, while the drumheads are stretched over metal edges, with acoustic benefits.

In accordance with an important aspect of the invention, a support band extends loosely about the shell 11, and at least part way about the studs 25 and 26; and elastomer cushions are carried by the support band and extend at least part way about the studs and adjacently face the shell to cushion axial and side loading transferred between the studs and support band, and to acoustically isolate the shell and support band; and drum support structure supports the support band.

In the example shown, the metallic support band 50 extends through an arc about the drum axis 51, that arc typically being between about 170° and 190° whereby multiple of the upper studs 25 are spanned. As shown, four of the upper studs are spanned to provide multiple supports for the band, with drum loading transferred to the band directly from the shell, via 40 and 25, and cushions to be described.

Relatively large size (diameter) elastomer cushions 52 are carried by the band 50 to receive drum side loading and drum axial loading, such side loading imposed directly from the shell to the annular side faces 52*a* of the cushions (see FIG. 5 and arrows 54), as the drum may be moved sidewardly back and forth during heavy use. Note points of engagement between the shell 11 and the cushion annular side face 52*a*, which faces toward axis 51.

The generally annular cushions typically extend closely about the studs 25 in arcuate planes substantially parallel to axis 51 and to 11*d*, and in isolation from the tensioning rods 36 and retainer structures 20 and 14, as shown. Note that the cushions extend closer to the shell than band extent adjacent the cushions. At least one of the multiple cushions engages the shell to receive imposed loading, and various of the cushions may engage shell wall 11*d* if the drum moves about, as during marching.

Figure 5:
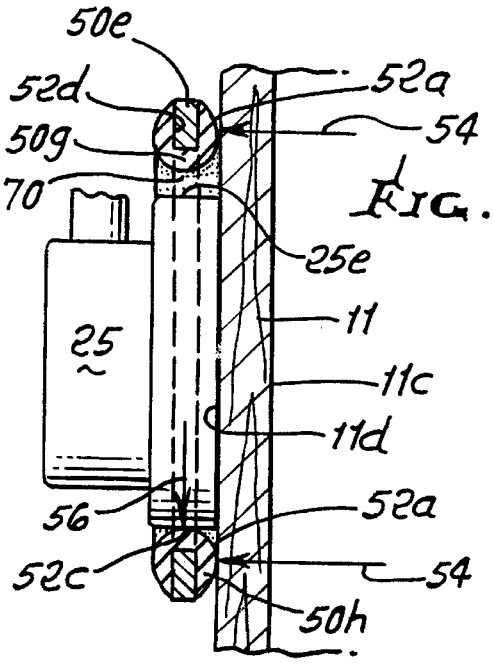
FIG. 5 is a section taken on lines 5—5 of FIG. 4.

FIG. 5 also shows drum axial loading transfer (see arrow 56) downwardly against cushion 52 inner face 52*c*, and at least two, and preferably all, such cushions may receive such downward loading, for transfer to the band 50, in isolation from the tension rods and drum head retainer structure 32–34 and 14.

The cushions are shown as comprising elastomeric grommets defining annular grooves 52*d* receiving inner annular edge extents 50*e* of the metallic band 50. See FIG. 5.

Figure 4:
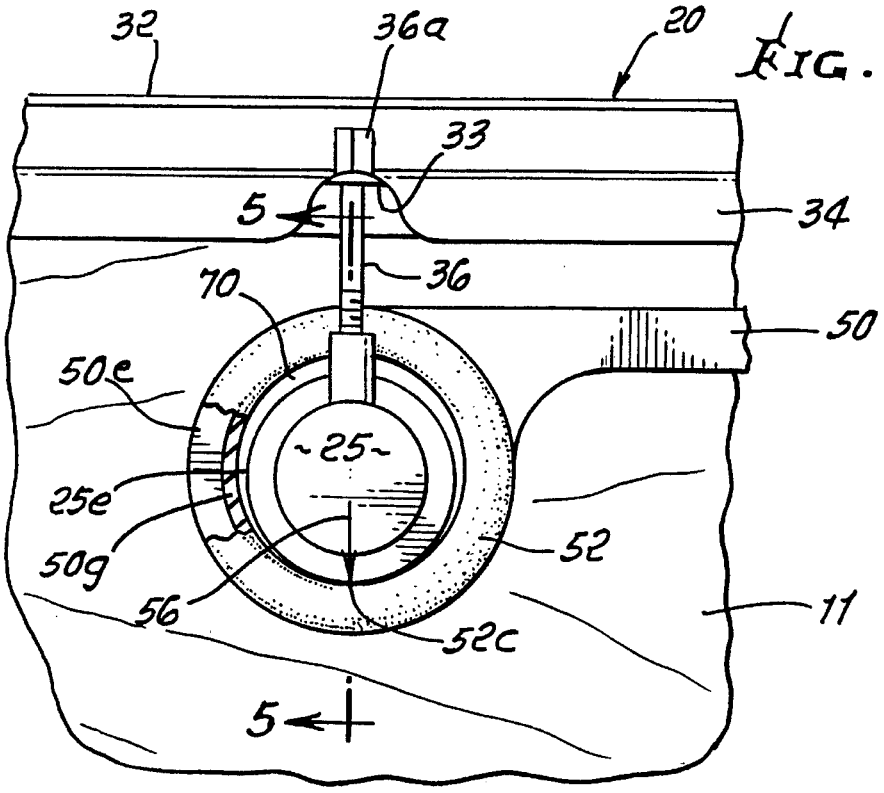
FIG. 4 is an enlarged elevation taken on lines 4—4 of FIG. 3.
Figure 6:
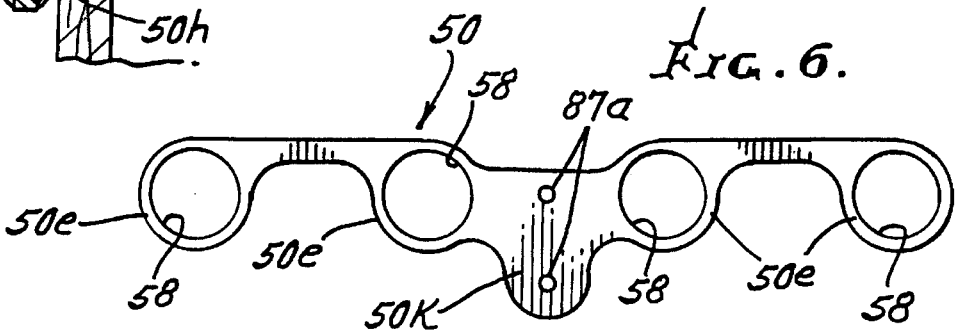
FIG. 6 is a view of the band of the invention, extended in a flat plane.

FIGS. 4 to 6 show such edge extents as defining circular through-openings 58 that receive the studs with grommet annular extents 50*g* located between the band edge extents 50*e* and the stud outer surfaces 25*e*. Grommet annular extents 50*g* provide cushioning for drum axial loading; and grommet annular extents 50*h* provide cushioning for drum side loading, whereby multiple cushioning functions are provided by the large-sized grommets. Note in FIG. 5 that the grommets have C-shaped cross sections in planes (i.e., such as the plane of FIG. 5, extending through the drum axis and through the cushions at their uppermost and lowermost extents, such C-shaped cross sections closely receiving edge extents of the band.

A small clearance 70 may exist between the uppermost cushion extent and the upper surface of the stud 25, whereby the grommets are easily assembled over the studs.

Figure 2:
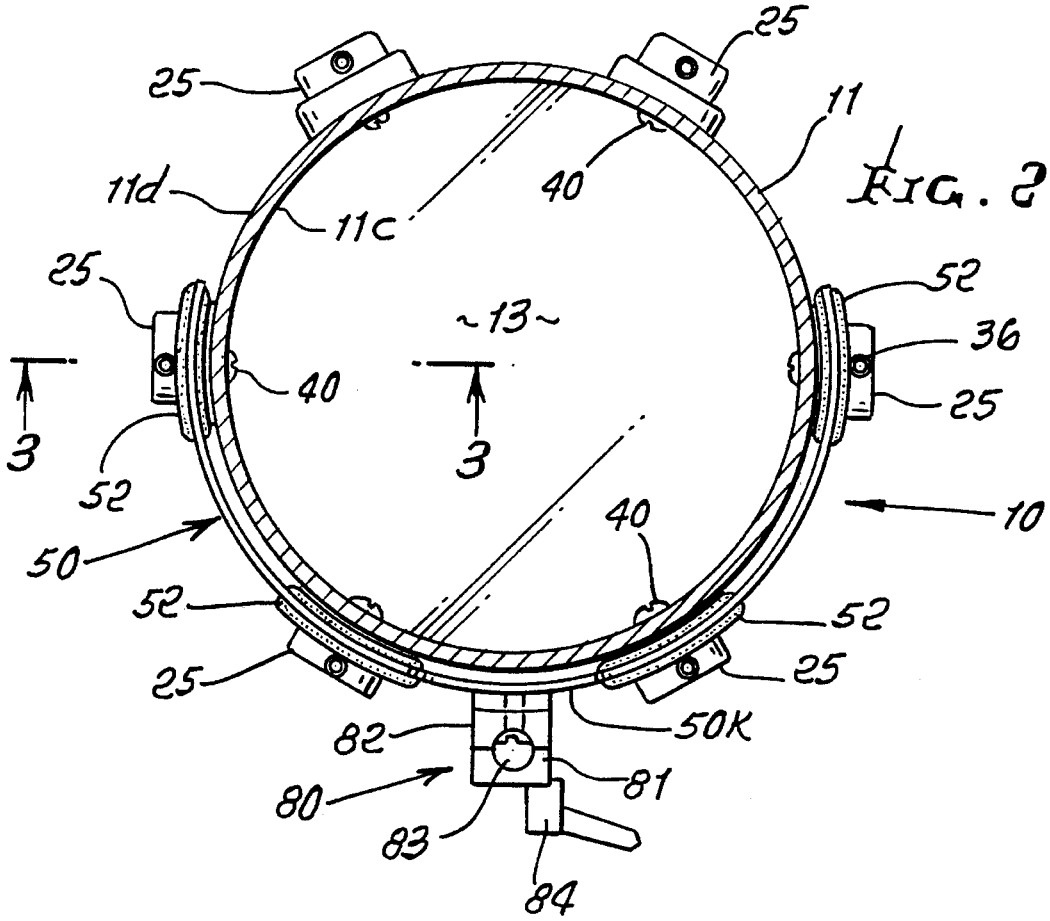
FIG. 2 is a plan view taken on lines 2—2 of FIG. 1.

Drum support structure on the band may take various forms. See the clamp structure 80 in FIGS. 1 and 2 that includes part 81 that may be tightened by rotation of handle 84 toward part 82, so as to clamp a support rod 83 between those parts. Elements 87 guide the movement of outer part 81 toward and away from inner part 82. Structure 80 is located on band extent 50*k* between two of the four studs 25, whereby two studs are located at each side of the structure 80, for drum loading and support balance. Drum weight loading is transferred from the band to rod 83 via structure 80. Elements 87 attach to the band via openings 87*a*.

I claim:

1. In a drum assembly, the combination comprising a) a cylindrical shell and a head on the shell, b) annular retainer structure on the shell and retaining the head to the shell, c) multiple studs rigidly attached to the shell at the outer side thereof, d) multiple threaded rods extending between said studs and said retainer structure, e) a support band extending about said shell, and at least part way about said studs, f) elastomer cushions carried by said support band and extending at least part way about said studs and adjacently facing said shell to cushion loading transferred between said studs and said support band, and to acoustically isolate said shell and support band, g) and drum support structure on said support band, h) said cushions elongated in different planes, each of which is generally parallel to a central axis defined by said shell.

2. The combination of claim 1 wherein said cushions extend closer to said shell than band extent adjacent the cushions.

3. The combination of claim 1 wherein said band is metallic and said cushions are elastomeric.

4. The combination of claim 3 wherein said cushions are annular and have inner edges extending between the band and the studs, and have side walls extending between the band and said shell.

5. The combination of claim 1 wherein the drum is a tom-tom.

6. In a drum assembly, the combination comprising a) a cylindrical shell and a head on the shell, b) annular retainer structure on the shell and retaining the head to the shell, c) multiple studs rigidly attached to the shell at the outer side thereof, d) multiple threaded rods extending between said studs and said retainer structure, e) a support band extending about said shell, and at least part way about said studs, f) elastomer cushions carried by said support band and extending at least part way about said studs and adjacently facing said shell to cushion loading transferred between said studs and said support band, and to acoustically isolate said shell and support band, g) and drum support structure on said support band, h) and wherein said cushions extend generally annularly about said studs and being elongated in planes generally parallel to a central axis defined by said shell.

7. In a drum assembly, the combination comprising a) a cylindrical shell and a head on the shell, b) annular retainer structure on the shell and retaining the head to the shell, c) multiple studs rigidly attached to the shell at the outer side thereof, d) multiple threaded rods extending between said studs and said retainer structure, e) a support band extending about said shell, and at least part way about said studs, f) elastomer cushions carried by said support band and extending at least part way about said studs and adjacently facing said shell to cushion loading transferred between said studs and said support band, and to acoustically isolate said shell and support band, g) and drum support structure on said support band, h) and wherein said cushions extend generally annularly about said studs and in planes generally parallel to a central axis defined by said shell, i) and wherein said cushions are spaced apart and about said axis, at least one of said cushions engaging the shell.

8. The combination of claim 7 wherein there are four of said cushions, spaced apart through an arc defined by the band, said arc extending between 170° and 190° about said axis.

9. In a drum assembly, the combination comprising a) a cylindrical shell and a head on the shell, b) annular retainer structure on the shell and retaining the head to the shell, c) multiple studs rigidly attached to the shell at the outer side thereof, d) multiple threaded rods extending between said studs and said retainer structure, e) a support band extending about said shell, and at least part way about said studs, f) elastomer cushions carried by said support band and extending at least part way about said studs and adjacently facing said shell to cushion loading transferred between said studs and said support band, and to acoustically isolate said shell and support band, g) and drum support structure on said support band, h) and wherein said cushions extend generally annularly about said studs and being elongated in planes generally parallel to a central axis defined by said shell, i) and wherein said cushions extend between said band and said studs.

10. The combination of claim 9 wherein said cushions also extend closer to said shell than band extent adjacent the cushions, said cushions being spaced apart and about said axis, at least one of said cushions engaging the shell.

11. In a drum assembly, the combination comprising a) a cylindrical shell and a head on the shell, b) annular retainer structure on the shell and retaining the head to the shell, c) multiple studs rigidly attached to the shell at the outer side thereof, d) multiple threaded rods extending between said studs and said retainer structure, e) a support band extending about said shell, and at least part way about said studs, f) elastomer cushions carried by said support band and extending at least part way about said studs and adjacently facing said shell to cushion loading transferred between said studs and said support band, and to acoustically isolate said shell and support band, g) and drum support structure on said support band, h) and wherein said cushions extend generally annularly about said studs and in planes generally parallel to a central axis defined by said shell, i) and wherein said cushions comprise elastomeric grommets defining annular grooves receiving edge extents of the band.

12. In a drum assembly, the combination comprising a) a cylindrical shell and a head on the shell, b) annular retainer structure on the shell and retaining the head to the shell, c) multiple studs rigidly attached to the shell at the outer side thereof, d) multiple threaded rods extending between said studs and said retainer structure, e) a support band extending about said shell, and at least part way about said studs, f) elastomer cushions carried by said support band and extending at least part way about said studs and adjacently facing said shell to cushion loading transferred between said studs and said support band, and to acoustically isolate said shell and support band, g) and drum support structure on said support band, h) said band being metallic and said cushion being elastomeric, i) said cushion being annular and having inner edges extending between the band and the studs, and having side walls extending between the band and the shell, j) and wherein said cushions have C-shaped cross sections in planes extending through the drum axis and through the cushions at their uppermost and lowermost extents, said C-shaped cross sections receiving edge extents of the band.

13. In a drum assembly, the combination comprising a) a cylindrical shell and a head on the shell, b) annular retainer structure on the shell and retaining the head to the shell, c) multiple studs rigidly attached to the shell at the outer side thereof, d) multiple threaded rods extending between said studs and said retainer structure, e) a support band extending about said shell, and at least part way about said studs, f) elastomer cushions carried by said support band and extending at least part way about said studs and adjacently facing said shell to cushion loading transferred between said studs and said support band, and to acoustically isolate said shell and support band, g) and drum support structure on said support band, h) said drum having an axis and said cushions having C-shaped cross sections in planes extending through the drum axis, and through the cushions at their uppermost and lowermost extents, said C-shaped cross sections receiving edge extents of the band.

* * * * *